US007220348B1

(12) United States Patent
Malone et al.

(10) Patent No.: US 7,220,348 B1
(45) Date of Patent: May 22, 2007

(54) METHOD OF PRODUCING HIGH SOFTENING POINT PITCH

(75) Inventors: Donald P. Malone, Grayson, KY (US); Howard F. Moore, Ashland, KY (US); Melvin D. Kiser, Huntington, WV (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 378 days.

(21) Appl. No.: 10/899,976

(22) Filed: Jul. 27, 2004

(51) Int. Cl.
*C10C 3/00* (2006.01)
*C10C 1/00* (2006.01)

(52) U.S. Cl. ..... 208/41; 208/6; 208/39; 208/40; 208/42; 208/43; 208/44; 208/113; 516/38

(58) Field of Classification Search ..... 208/6, 208/40, 41, 113, 39, 42, 43, 44; 516/38
See application file for complete search history.

(56) References Cited

U.S. PATENT DOCUMENTS

| | | | | |
|---|---|---|---|---|
| 3,197,413 | A * | 7/1965 | Wingerd | 516/38 |
| 4,591,424 | A * | 5/1986 | Gomi et al. | 208/40 |
| 4,925,547 | A | 5/1990 | Tsuchitani et al. | |
| 4,927,620 | A | 5/1990 | Ward et al. | |
| 6,402,937 | B1 | 6/2002 | Shaffer, Jr. et al. | |
| 6,402,938 | B1 | 6/2002 | Moore et al. | |
| 2002/0189974 | A1 * | 12/2002 | Adamson et al. | 208/113 |

* cited by examiner

*Primary Examiner*—Glenn A. Caldarola
*Assistant Examiner*—Prem C. Singh
(74) *Attorney, Agent, or Firm*—Emch, Schaffer, Schaub & Porcello Co., L.P.A.

(57) ABSTRACT

The present invention provides a way to increase the softening point of heavier hydrocarbons in a relatively low cost and low pressure process using superheated steam to i) increase the carbon yield of the heavier hydrocarbons, while simultaneously ii) removing volatile components with a steam stripping process.

9 Claims, 2 Drawing Sheets

METHOD OF PRODUCING HIGH SOFTENING POINT PITCH

FIELD OF THE INVENTION

The invention relates to a method of increasing a softening point and carbon yield of pitch.

BACKGROUND OF THE INVENTION

Extensive work has been reported in the patent literature on the use of hot, high pressure hydrogen for vaporization of used motor oil. In particular, the assignee herein, Marathon Ashland Petroleum LLC, owns Moore U.S. Pat. No. 6,402,938 which describes re-refining used motor oil by direct injection of a superheated, non-hydrogenating recycle vapor, and the Schaffer Jr. et al. U.S. Pat. No. 6,402,937 which is directed to a process for the direct contact heating and vaporization of used motor oil.

While superheated steam has been used to recycle used motor oil, until the present invention there has been no disclosure of using superheated steam distillation to increase the softening point and carbon yield of pitch.

Heavier hydrocarbons, such as petroleum pitch are used as a carbon precursor for many applications. One important characteristic of carbon precursors is the "carbon yield." Most commercially available petroleum pitches currently exhibit a carbon yield (as measured by the Modified Conradson Carbon method, ASTM D 2418) of 50 wt % or less. Pitch is used as a carbon precursor for the production of graphite electrodes, carbon fibers, carbon/carbon composites and the like. The efficiency of many of these applications is increased as a function of carbon yield.

Ward et al. (U.S. Pat. No. 4,927,620, Ward, et al., "Process for the manufacture of carbon fibers and feedstock therefore," May 22, 1990) teaches that the carbon yield of pitch can be increased by removal of the more volatile components of pitch via distillation techniques. To prevent undesirable changes in the pitch product due to thermal treatment, a short path distillation technique using a wiped film evaporator is utilized. Pitch product obtained from this process can have a softening point up to approximately 275° C. A corresponding increase in carbon yield as measured by the Modified Conradson Carbon method also increases up to approximately 80, and in some embodiments, 82 to 85 wt %. Successful implementation of this technique requires the use of extremely good vacuum during processing.

The injection of normal steam into distillation columns is known to reduce the effective vapor pressure of hydrocarbons (J. L. Kroschwitz, M. Howe-Grant, editors, "Steam Distillation," *Kirk-Othmer Encyclopedia of Chemical Technology,* 4$^{th}$ Edition, John Wiley & Sons, New York N.Y. 1993, Volume 8, pages 348, 349). The use of superheated steam has been demonstrated as a heat transfer medium in the production of coal tar and petroleum pitch (Tsuchitani, et al., U.S. Pat. No. 4,925,547, "Process for producing pitch for the manufacture of high-performance carbon fibers together with pitch for the manufacture of general-purpose carbon fibers," May 15, 1990).

It would be advantageous to provide an efficient method for increasing the softening point and also increasing the carbon yield of heavier hydrocarbons in a continuous manner.

It would also be advantageous to provide an efficient method for increasing the softening point and increasing the carbon yield of heavier hydrocarbons which does not require apparatus susceptible to clogging or fouling under normal processing conditions.

Until the present invention, however, there has not been a process that can be used to increase the softening point of heavier hydrocarbons by direct injection of superheated steam into the heavier hydrocarbons.

Until the present invention there has also not been a process that could be used to increase the carbon yield of heavier hydrocarbons by direct injection of superheated steam.

We devised a superheated steam distillation process which provides an effective short residence time distillation of heavy hydrocarbons without causing an excess of thermal treatment.

SUMMARY OF THE INVENTION

The present invention provides a way to process heavier hydrocarbons in a relatively low cost and low pressure facility using direct injection of superheated steam to increase the softening point and to increase the carbon yield of hydrocarbon products such as petroleum pitch. According to the process of the present invention, superheated steam is atomized with a liquid hydrocarbon material. This process causes the feed liquid to heat up rapidly and causes highly turbulent mixing. The process of the present invention can be controlled precisely to allow oil vapor from the feed liquid to condense and separate in one vessel while the steam is sent to a second vessel for condensation.

The pitch formed according to the present invention has a desired softening point. The softening point of the pitch relates to the ease or difficulty of processing and the high softening point pitch product according to the present invention provides easier processing.

Also, according to the present invention, the carbon yield of the pitch is increased, as analyzed by the Modified Conradson Carbon Method. This analysis provides a relative indicator of the effectiveness as a carbon precursor. The higher the carbon yield, the better the pitch product.

The pitch produced according to the process of the present invention also has a higher density than pitch produced using conventional techniques. The density of pitch often becomes an important factor since volume is limited in many carbon precursor applications. That is, for a given density, more carbon can be packed into a given volume. In many applications, the higher the density of the pitch, the better the product.

Another important property of pitch is the ratio of aliphatic to aromatic hydrocarbons. An increase the aromanticity of the pitch is normally accompanied with an increase in density; that is, a lower ratio is better.

Yet another important property of pitch is that the pitch structurally changes as it experiences thermal treatment. As the pitch is heated, the pitch transforms into a liquid crystal structure known as "mesophase". Further heat treatment results in the formation of coke. The pitch produced according to the present invention retains its desired structure without transforming into a "mesophase" material. The process of the present invention provides no evidence of product degradation as evidenced by the lack of any mesophase formation.

According to one embodiment, the present invention includes the use of at least one atomizer nozzle which combines at least one or more streams of the steam with a supply stream of the heavier hydrocarbons, and atomizes both streams such that the increase in softening point and the increase in carbon yield occur in an optimum manner.

In one aspect, the present invention relates to a process for increasing both the softening point and the carbon yield of hydrocarbon materials, such as petroleum pitch, and includes the steps of:

i) directly contacting at least one stream of the hydrocarbon materials with a stream of superheated steam under temperature, contact time, and superficial velocity conditions sufficient to at least partially increase the softening point of the hydrocarbon materials and to provide a desired volume of at least one product in at least one suitable disengaging vessel, and a remaining volume of volatile overhead product and steam;

ii) condensing the volatile overhead product in at least one stage;

iii) recovering at least part of the volatile overhead product as distillate;

iv) condensing the steam in a second stage, and v) recovering a product having a desired softening point and a desired carbon yield.

In certain embodiments, the hydrocarbon material is preheated prior to being directly contacted with the heated stream of superheated steam. Further, it is within the contemplated scope of the present invention that the hydrocarbon material can be at partially fractionated or flashed to remove a majority, by weight, of at least one of chemical solvents boiling in the gasoline boiling range and gasoline boiling range components prior to being contacted by the superheated steam.

In certain aspects, the contacting of the heavier hydrocarbons with the superheated steam can be carried out as a continuous process where the contacting of the heavier hydrocarbon material with the superheated stream of steam occurs in a flow mixing means, e.g., a nozzle.

In other embodiments, the present invention can be carried out as a batch process using a plurality of vessels.

In one preferred embodiment, the superheated stream of steam is introduced through an atomizing nozzle at temperatures ranging from about 450 to about 1800° F., preferably from about 700 to about 1100° F., at a vapor rate of about 0.1 to about 10 pounds/pound of charge, preferably about 2 to about 3 pounds/pound of charge and a superficial velocity of no greater than about 5.5 feet per second, preferably no greater than about 3 feet per second. The preferable velocities are such that the heavier hydrocarbon material is "atomized" into sufficiently small particles to turbulently mix with the superheated steam and yet low enough to prevent entrainment of undesired materials, such as organo-metallic compounds, in the volatile overhead product. In certain embodiments, such velocity is generally no greater than about 5.5 feet per second, preferably no greater than about 3 feet per second. Vaporization temperatures achieved in the nozzle can range from 400 to 1000° F., preferably 550 to 650° F. The heavier hydrocarbon material is contacted with the superheated stream of steam for a period ranging from about 0.1 to about 2 seconds, e.g., 1 second, preferably from about 0.25 to 0.5 seconds. The vaporization temperatures, stream rates, superficial velocities and contact times are adjusted to provide a preset volume reduction of the total amount of heavier hydrocarbon that has been introduced into the nozzle (or degree of lift of overhead vapors), e.g., ranging from about 20 to about 95 wt. %, preferably from about 60 to about 90 wt. % of the total amount of heavier hydrocarbon material introduced into the nozzle.

In one embodiment of the present invention, the volatile overhead product is condensed at a temperature above the condensing temperature of steam. The heated steam is then condensed in a second stage.

The above conditions may be varied to adjust the extent of softening and carbon yield of the hydrocarbon components in the heavier hydrocarbon materials.

In an especially preferred embodiment, the heated steam is superheated steam. The use of steam may lower partial pressure of the vaporization of the overhead so that vaporization temperatures no greater than 650° F. or even 600° F. can be used. Such lower vaporization temperatures combined with lower contact times may be particularly desirable inasmuch as they may minimize the decomposition of valuable product or additives in the hydrocarbon materials. For example, when the heavier hydrocarbon materials comprise used lubricating oils, there is minimal decomposition of such valuable additives as viscosity index improvers, pour point depressants, defoamants, and detergent-dispersants, which can be present in used lubricating oils in amounts of at least about 0.1 wt. %, e.g., ranging from about 0.1 to about 25 wt. %, preferably about 1 to about 10 wt. %.

DETAILED DESCRIPTION OF THE PREFERRED EMBODIMENT(S)

Figure 1:
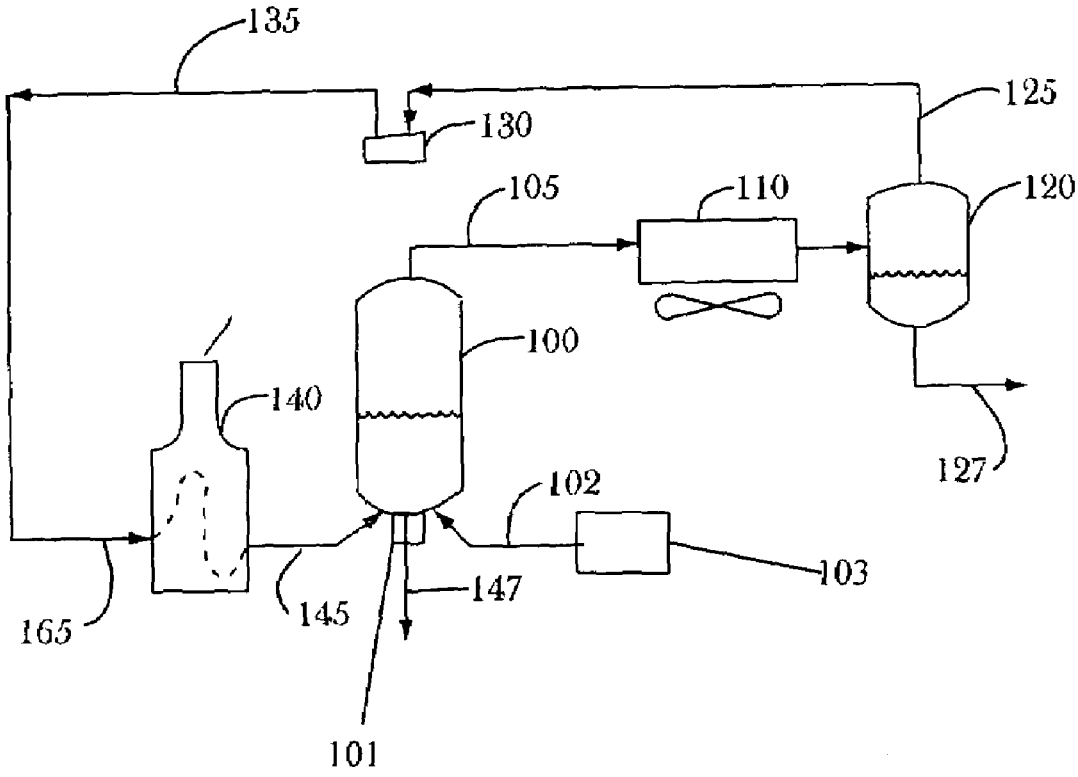
FIG. 1 is a schematic diagram illustrating a preferred embodiment of the process of the present invention.

Further features and advantages of the present invention will become apparent to those skilled in the art from the description of the preferred embodiment herein set forth.

The hydrocarbon materials that can be treated in accordance with the present invention include coal-derived hydrocarbon material, sand petroleum derived hydrocarbons, such as, for example, FCC/RCC slurry oil, asphalt, petroleum pitch and the like, used crankcase oil from motor vehicles such as, for example, cars, trucks and railroad locomotives, as well as automatic transmission fluids and other functional fluids in which the major constituent is an oil of lubricating viscosity. Unavoidably, used lubricating oil often contains amounts of water and other hydrocarbon liquids, e.g., light hydrocarbons having a boiling point of less than 600° F., e.g., less than 210° F. The present invention is especially advantageous inasmuch as no pre-separation of water and light hydrocarbons liquids is necessary.

According to the method of the present invention, such method is suitable for processing many types of products requiring a short path distillation technique. The present invention is, however, especially useful in the processing of petroleum pitch. The use of the superheated steam for the removal of volatile components from pitch products increases the carbon yield and the softening point of the resulting petroleum pitch product. The process of the present invention produces pitch which compares favorably to pitch produced by more conventional distillation techniques. Other advantages of the present invention process include a lower capital cost due to fewer moving parts in the processing equipment and a less complex processing unit due to the absence of vacuum pumps needed in conventional distillation techniques.

The use of the superheated steam, rather than normal steam allows separation of higher boiling point components.

For example, the initial boiling point of Marathon Ashland Petroleum A240 pitch is approximately 565° F. with 25% boiling above 850° F. Production of pitch where there is an increase in the softening point above 450° F. is difficult using conventional distillation techniques.

Pitch produced using the process of the present invention has a higher density than pitch produced in conventional distillation techniques. The higher density pitch is more desirable to customers using the product as a carbon precursor.

Pitch produced using the process of the present invention has less aliphatic hydrogen present. Higher aromanticity is more desirable to customers using the product as a carbon precursor.

The superheated steam process of the present invention is also suitable for processing streams containing excess quantities of water. In some instances processed streams may contain relatively large amounts of water. Such high water content process streams are unsuited for processing by conventional distillation techniques such as atmospheric or vacuum distillation. Further, excess water can destroy equipment in conventional distillation towers used for atmospheric operations. Also, excess of water is detrimental to vacuum distillation operations, both conventional and white film, since the water vapor causes difficulty in maintaining the needed vacuum.

In contrast, since the superheated steam process of the present invention requires water in the form of steam to be atomized with the product, the presence of water in the sample will have few consequences.

The process of the present invention is useful to distill pitch products regardless of the origin of the pitch products. While the example herein is demonstrated with petroleum derived pitch products, the superheated steam process can be used for processing other types of hydrocarbons such as those derived from coal, or other processing activities due to the similarities in physical properties of the heavier hydrocarbon materials.

Included within the group of hydrocarbon materials suitable for treatment herein are used motor oils having mineral lubricating oils such as liquid petroleum oils and solvent-treated or acid-treated mineral lubricating oils of the paraffinic, naphthenic or mixed paraffinic-naphthenic types as the base oil. Oils of lubricating viscosity derived from coal or shale oil can also be included as the base oil of such used motor oils. This group also includes used motor oils having as the base oil synthetic lubricating oils including hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof, alkylbenzenes (e.g., dodecylbenzenes, tetradecylbenzenes, dinonylbenzenes, di(2-ethylhexyl)benzenes, etc.): polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils that can be the base oil of the used lubricating oils treated in the present invention. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diethyl ether of polyethylene glycol having a molecular weight of 500-1000, diethyl ether of polypropylene glycol having an average molecular weight of 1000-1500, etc.) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils that can be the base oil of the used lubricating oils treated by the present invention comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyladipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils that the used lubricating oils to be treated can be derived from include $C_5$-$C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of synthetic oils that can be the base oil of the used lubricating oils that can be treated (e.g., tetraethyl silicate, tetraisopropyl silicate, tetra-(2-ethylhexyl) silicate, tetra-(4methyl-2-ethylhexyl) silicate, tetra-(p-tert-butylphenyl)silicate, hexa(4-methyl-2-pentoxy)-disiloxane, poly(methyl)siloxanes, poly(methylphenyl)siloxanes, etc.). Other synthetic oils include liquid esters of phosphorus-containing acids (e.g., tricresyl phosphate, trioctyl phosphate, diethyl ester of decylphosphonic acid, etc.), polymeric tetrahydrofurans and the like.

The term "lubricating oil" when used herein does not limit the utility of the oil to lubricating, but is merely a description of a property thereof, namely, that the oil is of lubricating viscosity.

The foregoing used lubricating oils usually contain one or more of various additives such as, for example, oxidation inhibitors (i.e., barium, calcium and zinc alkyl thiophosphates, di-t-butyl-p-cresol, etc.), anti-wear agents (i.e., organic lead compounds such as lead diorganophophorodithioates, zinc dialkyldithiophosphates, etc.), dispersants, (i.e., calcium and barium sulfonates and phenoxides, etc.), rust inhibitors (i.e., calcium and sodium sulfonates, etc.), viscosity index improvers, (i.e., polyisobutylenes, polyalkylstyrene, etc.), and detergents (i.e., calcium and barium salts of alkyl and benzene sulfonic acids and ashless type detergents such as alkyl-substituted succinimides, etc.). Additionally, the used lubricating oils treated in accordance with the present invention usually contain various contaminants resulting from incomplete fuel combustion as well as water and gasoline.

The process of the present invention is particularly suitable for removing or reducing to acceptable levels (e.g., to permit subsequent hydrogenation without poisoning the hydrogenation catalyst) the above-indicated nitrogen-containing materials and metal-containing materials.

In certain embodiments, the process of the present invention reduces or eliminates the need for further hydrogenation of the oxidized hydrocarbon materials. FIG. 1 is a simplified process flow diagram from which most pumps, heat exchangers and the like have been omitted. A vaporizer or vessel 100 is operatively connected to at least one atomizing nozzle 101. The nozzle 101 receives a liquid feed stream of heated heavier hydrocarbon material via 102 from a heating vessel 103. The nozzle also receives a supply, or stream, of superheated steam from line 145. In the vessel 100 the hydrocarbon materials are heated such that a heavier liquid product and a ligher overhead, or volatile, product are produced. The overhead volatile product and steam are removed overhead via line 105 and charged to fan cooler 110. The stream then is charged to a hot separator vessel 120, which preferably operates at a temperature low enough to condense essentially all of the volatile product and yet be at a temperature above the condensing temperature of steam. The now condensed overhead hydrocarbon product is removed from the vessel 120 via line 127. The superheated steam is removed as a vapor via line 125 to a suitable condenser 130. The condensed steam is then charged via lines 135 and 165 to a heater 140. The superheated steam is supplied via line 145 to the atomizing nozzle 101. At least periodically, a high softening pint, high carbon yield softening point pitch fraction is withdrawn from vessel 100 via line 147.

In one embodiment, the stream of steam is preferably superheated to a temperature of 700 to 1600° F. The stream is introduced into the nozzle 101 at a rate of 1 to 3 pounds/pound of charge, in order to further heat the heavier hydrocarbon materials to a preferred temperature.

In certain embodiments, the hydrocarbon material can be preheated prior to directly contacting the at least one stream of the hydrocarbon materials with the heated stream of superheated steam. Also, hydrocarbon material can be at least partially fractionated or flashed to remove a majority by weight of at least one of chemical solvents boiling in the gasoline boiling range and gasoline boiling range components prior to being contacted by the steam. The required contact time for the heavier hydrocarbon material is dependent on the composition of the heavier hydrocarbon material. In embodiments where there is a concentration of organo-metallic compounds in the used oil, the desired extent of decomposition of the organo-metallic compounds and the desired volume reduction and degree of lift, the introduction rate of the mixture is adjusted to avoid entrainment of organo-metallic compounds into the overhead fraction which contains water, light hydrocarbons, and distillatable oil.

The process of the present invention is preferably carried out in a vessel stirred by the action of the impinging velocity of the heated streams of heavier hydrocarbon materials and steam being introduced therein. The vessel can be entirely conventional in design and construction. The size, design and construction of such vessel are dependent upon the volume and type of heavier hydrocarbon materials to be processed. In one embodiment, stream of atomized hydrocarbon material and stream of superheated steam from the nozzle enters at the bottom of the vessel, the volatile overhead product and steam exits at the top of the vessel, and the residue is drained from the bottom of the vessel. No internal components are necessary.

It is to be understood that the overhead fraction can be passed through a vacuum distillation column (not shown) wherein lighter hydrocarbons (suited to use as fuel gas after separation) are taken off as overhead. Also, the distillate product may be recovered as a single product but is typically fractionated to produce a number of distillate fractions which have the boiling range of the final product desired. Different fractions are taken off the column at separate collection points and collected. The collected distillate product may be further treated by catalytic hydrogenation or clay treatment (not shown) to reduce sulfur content, improve color, saturate olefins and thereby increase stability and reduce gum forming compounds. The vacuum bottoms are also taken off and may be used as fuel oil, asphalt extender, feedstock for delayed coking, feedstock for partial oxidation or a gasifier or for cement kiln fuel where the metal would remain in the product cement. The bottoms fraction from the vessels are removed and are directed through a suitable line (not shown) for addition to fuel oil or, alternatively, directed for mixing with asphalt in a suitable asphalt mixing means.

Figure 2:
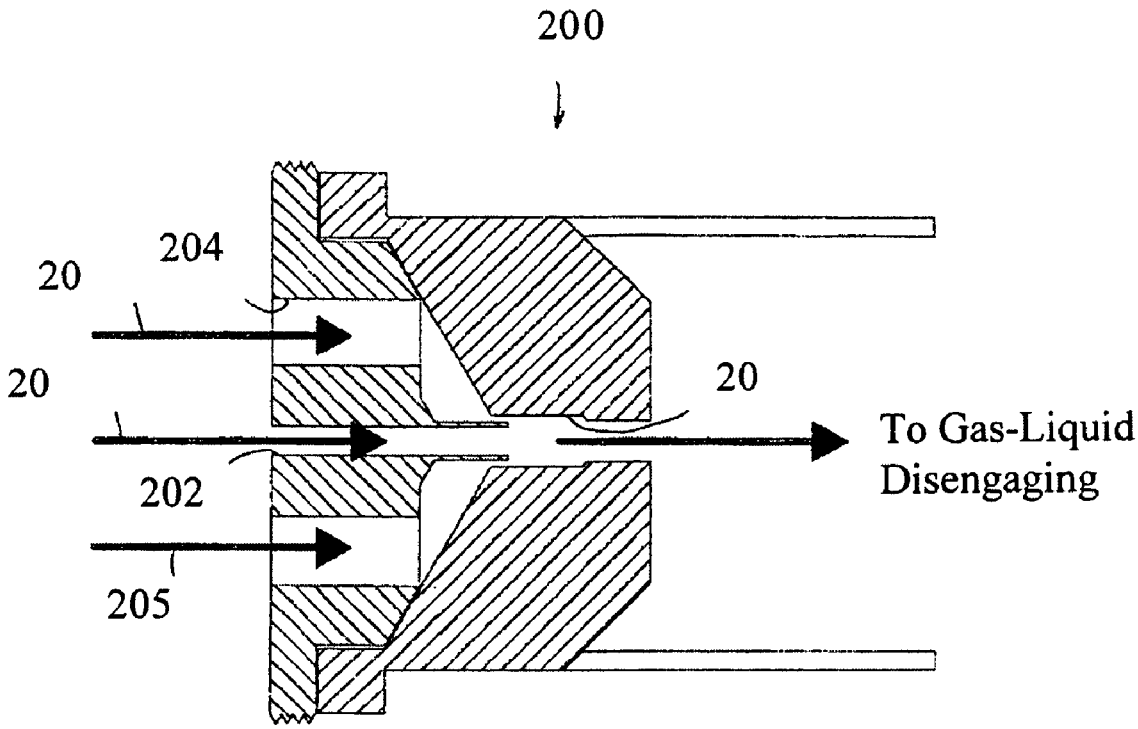
FIG. 2 is a schematic diagram illustrating an atomizing nozzle useful in the process of the present invention.

FIG. 2 is a schematic illustration of an atomizing nozzle 200. The nozzle 200 defines a first opening 202 for receiving a supply 203 of the heavier hydrocarbon material. The nozzle 200 further defines an annular opening 204 which coaxially surrounds the first opening 202. The annular opening 204 receives a supply 205 of the stream of superheated steam. The annular opening 204 of the nozzle 200 has a desired shape such that the stream of superheated steam readily mixes with the supply of heavier hydrocarbon materials being injected into the nozzle 200. The annular opening 204 and the first opening 202 terminate at a mixing channel 208. The velocity of the superheated steam stream 205 and the heavier hydrocarbon material 203 causes the heavier hydrocarbon material to be atomized.

By way of further illustration of the process of the present invention, reference may be made to the following example. Unless otherwise indicated, all parts and percentages are by weight.

EXAMPLE 1

Heavier hydrocarbon material near ambient temperature was heated and then injected on the atomizing nozzle where the heavier hydrocarbon material was mixed rapidly with the superheated steam. The steam-light overhead mixture was cooled first to 225° F., where most of the overhead product condensed. The steam was condensed and collected in a water condensate accumulator. The process avoided indirect heat transfer while ensuring that the highest temperature the heavier hydrocarbon material reached was the atomizer outlet temperature. The atomized heavier hydrocarbon material was cooled quickly so residence time at atomizer temperature was short. Steam stripping allowed a lower flash temperature for a given amount of heavier hydrocarbon material vaporization compared to atmospheric or even moderate subatmospheric flash vaporization. An equal weight of steam to heavier hydrocarbon material charge is equivalent to moderate vacuum flashing because the molecular weight of steam is 10 to 30 times less than that of heavier hydrocarbon material.

EXAMPLES 2, 3, 4 and 5

A superheated steam stripper is employed that uses commercially available nozzles to atomize feed liquid with superheated steam. This process causes the feed liquid to heat up rapidly and causes highly turbulent mixing. Precise temperature control allows the oil vapor to condense and separate in one vessel, with the steam sent to a second vessel for condensation. A small, laboratory size unit as set to demonstrate this process with a commercially available pitch (Marathon Ashland Petroleum LLC A-240 petroleum pitch) used as a feedstock. To allow direct comparison of this process to the process described by Ward et al. various high softening point pitches were produced via both the distillation using wiped film evaporator technology (WFE) and the superheated steam process of the present invention from the same batch of A-240 pitch. Routine analytical techniques were used to characterize the products. In addition, the ratio of aliphatic hydrogen to aromatic hydrogen was determined by dividing the intensity of the aliphatic hydrogen peak by the aromatic hydrogen peak as measured by proton nuclear magnetic resonance spectroscopy (NMR). The present (or absence) of mesophase is determined by the examination of polished specimens under reflected polarized light at 400× to 1,000× magnifications. Mesophase will exhibit a bi-reflectance as the specimen is rotated from 0° to 900. Results are shown below in Tables I, II, III and IV.

TABLE I

| | | Example 2 60 Coking Value Pitch | |
|---|---|---|---|
| Characteristics | Test Method | High Softening Pt. Pitch Produced Via WFE Distillation | High Softening Pt. Pitch Produced Via Superheated Steam Stripping |
| Softening Point, | | | |
| ° C. | ASTM | 173 | 160.0 |
| ° F. | D 3104 | 343 | 334 |
| Coking Value, wt % | ASTM D 2416 | 68.4 | 63.0 |
| Density, Helium Pycnometer, g/cc | ASTM D 4892 | 1.24 | 1.27 |
| Sulfur, wt % | ASTM D 1552 | 2.0 | — |
| Ratio of Aliphatic Hydrogen to Aromatic Hydrogen (Proton NMR) | | 0.83 | 0.79 |
| Mesophase Content By Optical Microscopy | | Nil | Nil |

TABLE II

| | | Example 3 70 Coking Value Pitch | |
|---|---|---|---|
| Characteristics | Test Method | High Softening Pt. Pitch Produced Via WFE Distillation | High Softening Pt. Pitch Produced Via Superheated Steam Stripping |
| Softening Point, | | | |
| ° C. | ASTM | 203.8 | 204.0 |
| ° F. | D 3104 | 399 | 400 |
| Coking Value, wt % | ASTM D 2416 | 70.0 | 71.5 |
| Density, Helium Pycnometer, g/cc | ASTM D 4892 | 1.25 | 1.27 |
| Sulfur, wt % | ASTM D 1552 | 2.0 | — |
| Ratio of Aliphatic Hydrogen to Aromatic Hydrogen (Proton NMR) | | 0.79 | 0.78 |
| Mesophase Content By Optical Microscopy | | Nil | Nil |

TABLE III

| | | Example 4 75 Coking Value Pitch | |
|---|---|---|---|
| Characteristics | Test Method | High Softening Pt. Pitch Produced Via WFE Distillation | High Softening Pt. Pitch Produced Via Superheated Steam Stripping |
| Softening Point, | | | |
| ° C. | ASTM | 231 | 235 |
| ° F. | D 3104 | 448 | 455 |
| Coking Value, wt % | ASTM D 2416 | 75.8 | 75.1 |
| Density, Helium Pycnometer, g/cc | ASTM D 4892 | 1.26 | 1.28 |
| Sulfur, wt % | ASTM D 1552 | 2 | — |
| Ratio of Aliphatic Hydrogen to Aromatic Hydrogen (Proton NMR) | | 0.73 | 0.71 |
| Mesophase Content By Optical Microscopy | | Nil | Nil |

TABLE IV

| | | Example 5 80 Coking Value Pitch | |
|---|---|---|---|
| Characteristics | Test Method | High Softening Pt. Pitch Produced Via WFE Distillation | High Softening Pt. Pitch Produced Via Superheated Steam Stripping |
| Softening Point, | | | |
| ° C. | ASTM | 258 | 269 |
| ° F. | D 3104 | 496 | 516 |
| Coking Value, wt % | ASTM D 2416 | 81.4 | 79.5 |
| Density, Helium Pycnometer, g/cc | ASTM D 4892 | 1.26 | 1.30 |
| Mesophase Content By Optical Microscopy | | Nil | Nil |

EXAMPLE 6

In certain preferred embodiments when heavier hydrocarbons such as used motor oils (UMOs) are being treated there are no substantial carryover of metals into the volatile overhead product which means that the overhead product contains no greater than 100 ppm, preferably no greater than 50 ppm metals content. In contrast, the heavier hydrocarbon material feed can contain from 3000 to 5000 ppm metals. Metals content includes all metals present including organo-metallic compounds, partially decomposed organo-metallic compounds, and completely decomposed organo-metallic compounds.

Modifications

Specific compositions, methods, or embodiments discussed are intended to be only illustrative of the invention disclosed by this specification. Variations on these compositions, methods, or embodiments are readily apparent to a person of skill in the art based upon the teachings of this specification and are, therefore, intended to be included as part of the invention disclosed herein.

Reference to documents made in the specification is intended to result in such patents or literature being expressly incorporated herein by reference, including any patents or other literature references cited within such documents.

We claim:

1. A process for increasing the softening point and increasing the carbon yield of hydrocarbon materials which comprises:

a) directly contacting at least one stream of the hydrocarbon materials with a heated stream comprising steam superheated under temperature, contact times, and superficial velocity conditions sufficient i) to increase the softening point of the hydrocarbon materials and ii) to provide a desired volume of liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the liquid products, wherein the contacting of the hydrocarbon stream and the superheated steam is carried out in at least one atomizing nozzle, wherein the hydrocarbon materials pass through the atomizing nozzle; and wherein the at least one atomizing nozzle substantially surrounds a supply of the hydrocarbon material with the stream of the superheated steam, wherein heated stream of steam is vaporized at temperatures ranging from 450 to 1800° F., a vapor rate of 0.1 to 10 pounds heated vapor per pound of charge, and a superficial velocity of about 5.5 feet per second or less, to provide vaporization temperatures ranging from about 400 to 1000° F., and the hydrocarbon material is contacted with the superheated stream of steam for a period ranging from 0.1 to 2 seconds.

2. The process of claim 1, which is carried out in the absence of process fouling.

3. The process of claim 1, wherein the vaporization temperatures, vapor rate, superficial velocity, and contact times are adjusted to provide a volume reduction of the total amount of the hydrocarbon materials ranging from 20 to 95 wt. %.

4. A process for increasing the softening point and increasing the carbon yield of hydrocarbon materials which comprises:

a) directly contacting at least one stream of the hydrocarbon materials with a heated stream comprising steam superheated under temperature, contact times, and superficial velocity conditions sufficient i) to increase the softening point of the hydrocarbon materials and ii) to provide a desired volume of liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the liquid products, wherein the contacting of the hydrocarbon stream and the superheated steam is carried out in at least one atomizing nozzle, wherein the hydrocarbon materials pass through the atomizing nozzle; and wherein the at least one atomizing nozzle substantially surrounds a supply of the hydrocarbon material with the stream of the superheated steam, wherein the superheated stream of steam is introduced in the atomizing nozzle at temperatures ranging from 700 to 1100° F., at a rate of 2 to 3 pounds per pound charge, and a superficial velocity of at least about 3 feet per second to provide vaporization temperatures in the atomizing nozzle ranging from about 550 to about 650° F., and the hydrocarbon material is contacted with the stream of superheated steam for a period ranging from 0.25 to 0.5 seconds.

5. The process of claim 1, wherein heated steam is recovered from the volatile overhead product and recycled to the atomizing nozzle.

6. The process of claim 1, wherein the hydrocarbon material comprises at least one of FCC/RCC slurry oil, asphalt or petroleum pitch.

7. A process for increasing the softening point and increasing the carbon yield of hydrocarbon materials which comprises:

a) directly contacting at least one stream of the hydrocarbon materials with a heated stream comprising steam superheated under temperature, contact times, and superficial velocity conditions sufficient i) to increase the softening point of the hydrocarbon materials and ii) to provide a desired volume of liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the liquid products, wherein the contacting of the hydrocarbon stream and the superheated steam is carried out in at least one atomizing nozzle, wherein the hydrocarbon materials pass through the atomizing nozzle; and wherein the at least one atomizing nozzle substantially surrounds a supply of the hydrocarbon material with the stream of the superheated steam, wherein the hydrocarbon materials comprise raw used lubricating oil with light ends having a boiling point of less than about 210° F.

8. The process of claim 1, wherein the hydrocarbon material is preheated prior to directly contacting with the superheated steam.

9. The process of claim 8, wherein the hydrocarbon material is at least partially fractionated or flashed to remove a majority, by weight, of at least one of chemical solvents boiling in the gasoline boiling range and gasoline boiling range components prior to being contacted by the steam.

* * * * *